US005102018A

United States Patent [19]

Desazars de Montgailhard, William et al.

[11] Patent Number: 5,102,018

[45] Date of Patent: Apr. 7, 1992

[54] MINIATURE DISPENSER HAVING A VENTING GROOVE IN THE PUMP HOUSING

[75] Inventors: Desazars de Montgailhard, William, Paris; Jean-Louis Bougamont, Eu, both of France

[73] Assignee: Societe Francaise d'Aerosols et de Bouchage, Friville-Escarbotin, France

[21] Appl. No.: 547,724

[22] Filed: Jul. 2, 1990

[30] Foreign Application Priority Data

Jul. 4, 1989 [FR] France ..... 89 08941

[51] Int. Cl.[5] ..... B05B 9/04

[52] U.S. Cl. ..... 222/321; 222/378; 222/387

[58] Field of Search ..... 222/320, 321, 251, 372, 222/378, 383, 385, 387; 215/272

[56] References Cited

U.S. PATENT DOCUMENTS

| | | | |
|---|---|---|---|
| 3,228,571 | 1/1966 | O'Donnell et al. | 222/385 X |
| 3,627,206 | 12/1971 | Boris | 222/385 X |
| 3,774,849 | 11/1973 | Boris | 222/321 X |
| 4,144,987 | 3/1979 | Kishi | 222/385 X |
| 4,174,790 | 11/1979 | Nozawa et al. | 222/385 X |
| 4,311,255 | 1/1982 | Meshborg | 222/321 X |
| 4,420,096 | 12/1983 | Kirk, Jr. | 222/321 X |
| 4,435,135 | 3/1984 | Knickerbocker | 222/321 X |
| 4,964,547 | 10/1990 | Lina | 222/321 X |
| 4,991,747 | 2/1991 | Van Brocklin | 222/385 X |

*Primary Examiner*—Michael S. Huppert
*Assistant Examiner*—Kenneth DeRosa
*Attorney, Agent, or Firm*—Pennie & Edmonds

[57] ABSTRACT

A liquid dispensing device having a pump carrying the internal mechanism disposed in a container part of the device. The pump has a flange which rests on the upper edge of the container and which is connected to an outer bush member. The bush member is fitted on an outer bearing surface of the wall of the container in radial sealing engagement therewith. The pump includes a venting passageway for connecting the interior of the container to the atmosphere during dispensing of the liquid. In assembling the device, the pump and bush member are first connected together and then connected to the container with the pump in a position to maintain the passageway open to the interior of the container.

6 Claims, 1 Drawing Sheet

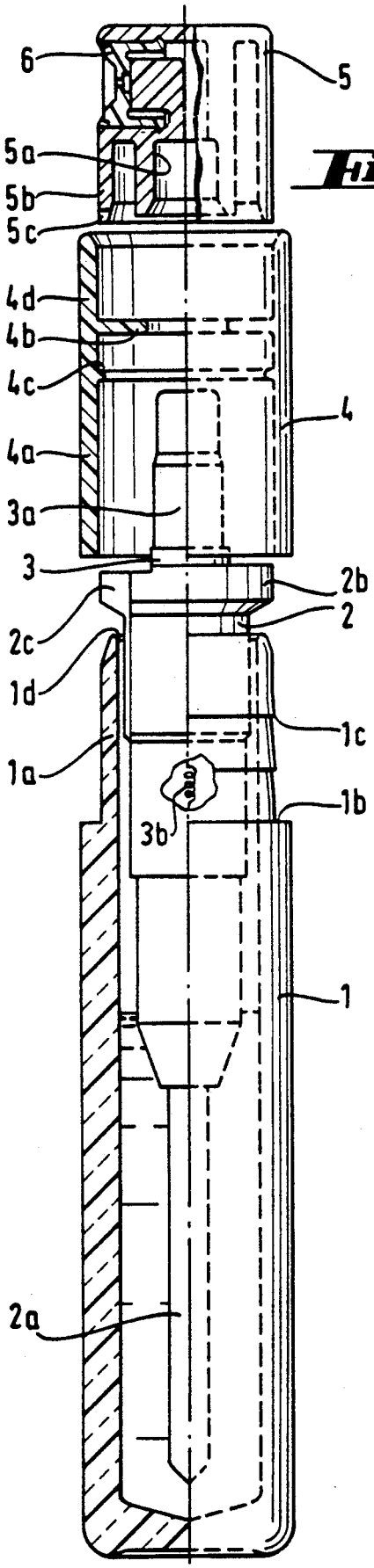
Fig. 1
Fig. 2
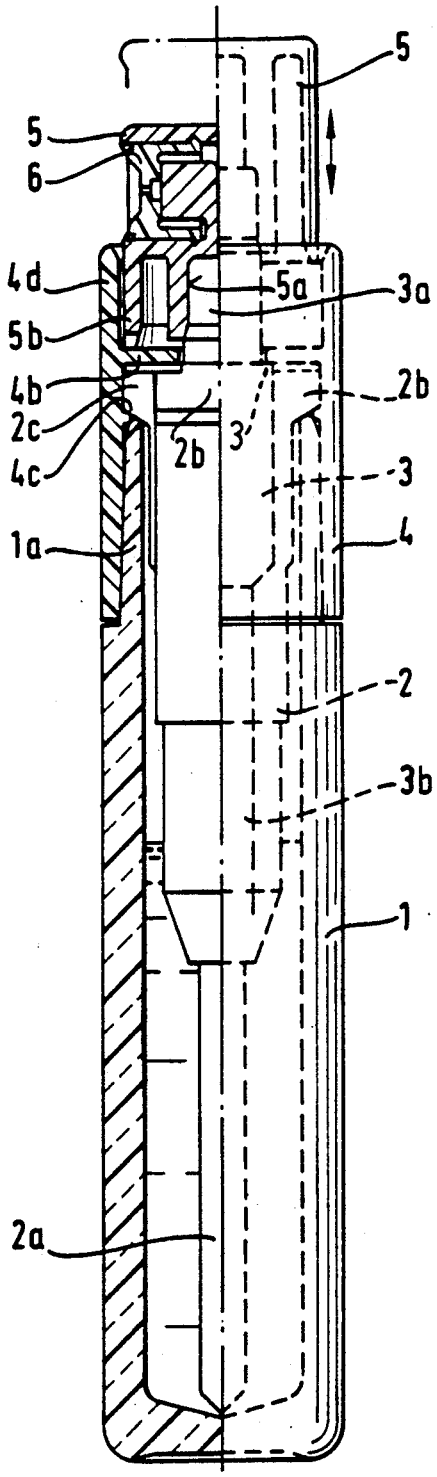

MINIATURE DISPENSER HAVING A VENTING GROOVE IN THE PUMP HOUSING

BACKGROUND

The invention relates to dispensing devices e.g. intended for the distribution of medicaments used in very small doses or to the distribution of perfume samples. Such devices are designed around known miniature dosing pumps with a piston carrying an axial moveable nozzle and whose body substantially has a diameter of approximately 7 mm for a length of approximately 3 cm, under an assembly collar projecting by approximately 1 mm, but which is not necessarily circular, whereby their outer volume may not exceed 4 or 5 $cm^3$, with a diameter of approximately 10 to 12 mm, while their capacity varies between about 50 and 10 doses, i.e. drops to 1 ml.

The above type structure makes it possible to construct such devices in very large numbers at very low cost. It can also apply to slightly larger models, but its characteristics would then generally lose part of their interest.

Known dispensing devices include a pump carrying the internal mechanism disposed in a container part of the device. The pump has a flange which rests on the upper edge of the container and which is connected to an outer bush member. The bush member is fitted on an outer bearing surface of the wall of the container. A construction of the type just described is the subject of U.S. Pat. No. 4,311,255. There, the bush member forms a can covering the entire length of the container.

The adoption of a generally cylindrical shape for the container and for the bush member makes it possible to make them from synthetic materials and more generally thermoplastic materials, which are injection molded in the same way as most of the pump components. If the container fits along the pump in glove finger-like manner, it leads to minimum transverse dimensions. Unlike other assembly methods, this method enables the cross-section of the device to slightly vary from a circular contour, while retaining a substantially uniform thickness of the wall.

The assembly only exerts easily withstood compressive stresses on the components, and with regard to such small components, the precision inherent in injection molding makes it possible to bring about a substantially non-dismantlable, tight assembly.

The assembly of the device can take place on an already filled container using existing machines, after a small number of modifications have been made, by engaging the bush member to which the pump has already been attached to form a sub-unit. In order to facilitate the assembly operation, the bush member can carry a ring locking the collar of the pump to the bush member.

Numerous materials are available and they will be chosen as a function of the product to be stored and will preferably be relatively rigid in order to avoid deformations, but without creating excessive local stresses.

One obstacle to be overcome in the assembly of the parts of the dispensing device is the obvious need of evacuating the occluded air from the container as the bush member and pump are assembled into the container. For this purpose, the prior art devices, such as shown in U.S. Pat. No. 4,311,255, have constructed the container part or bush member with interfacing longitudinal grooves through which the air can escape from the container during assembly of the device. With such constructions, the container and bush member are sealed at the end of the assembly operation by axial abutment of the upper end of the container against an upper cover wall of the bush member.

This solution has apparently not been industrially realized. The reason for this may be that the inversion of the curvature created on the wall of the container to form the grooves makes it necessary to reinforce the latter, which is not very acceptable in the case of miniature devices. Also, it would be difficult to obtain the precision necessary for the final sealing on the abutting end of the grooves.

SUMMARY OF THE INVENTION

The present invention is based on the discovery that specific air evacuation passages or grooves are not necessary in the case of pumps constructed with conventional venting passageways used in conjunction with the normal dispensing of liquid from the container. Such a venting passageway exists in order to enable the air to enter the container during each dispensing operation of the pump in order to balance the pressure inside the container.

In accordance with the present invention, the venting passageway of the pump is artificially opened during assembly of the device in order to make it fulfill a reverse air venting function rather than its normal air filling function. Thus, the radially engaging bearing surfaces of the base member and container wall can retain the same and preferably convex contour and do not require the air grooves of the prior art constructions. This leads to a significant diameter saving on the overall diameter of the device, but in particular an increase in strength, precision and therefore ease of assembly.

DESCRIPTION OF THE DRAWINGS

FIG. 1 is an exploded side view of the dispensing device with the left side thereof shown in cross-section; and FIG. 2 is a side view of the assembled device with the left side thereof shown in cross-section.

DESCRIPTION OF THE PREFERRED EMBODIMENT

The dispensing device (sprayer or atomizer) has a container formed by a narrow tube 1 which in the present case is made from transparent polyethylene terephthalate. The tube has a circular cross-section, which is injection molded and cylindrical at its lower end. The thickness of the wall is reduced in its upper end 1*a*, so as to form a very slightly conical outer bearing surface terminating in an outer shoulder 1*b* where it meets the lower end.

The tube receives a pump with a small lateral clearance. The pump has successive cylindro-conical ferrules of revolution and terminates at its lower end with an integrated fill tube 2*a*. The pump carries at its upper end a collar 2*b*; and both the pump at its upper end and the collar have at least one groove 2*c* serving as a vent passageway for the container. The pump 2 contains the mechanism of the piston 3, whose rod 3*a* constitutes the pump nozzle. The piston 3 closes the vent passageway 2*c* against communication with the atmosphere in the inoperative state of the pump, as more fully described below.

The pump and container are covered by a cylindrical bush member 4, which is also injection molded and in the present case is made from polyamide. The bush member has a skirt 4*a* with the same outer contour as the lower end of the tube 1, offering on its inner face a bearing surface, whose conicity corresponds to that of the corresponding bearing surface of the tube end 1*a*. The bush member is closed toward its upper end by a radial inwardly extending flange 4*b*. The flange has a central opening through which the nozzle of the pump extends. In the present case, the bush member also extends upwardly from the flange 4*b* to form a ferrule 4*d*.

The inner face of the skirt 4*a* of the bush member is smooth, with the exception of a locking ring 4*c*, whose function will become apparent hereinafter and which must not prevent the extraction of the die from the mold. With certain materials and preferably by using a shell mold, the outer face of the upper part 1*a* of the tube can, as shown in the right-hand part of FIG. 1, carry sealing ribs 1*c*. However, it is not necessary to have them here due to the strength of the materials used and if they lead to objectionable external appearance deficiencies.

An atomizing head 5 carrying a spraying means 6 is placed on the nozzle 3*a* by means of a seat 5*a*, masked by the lower skirt 5*b*. The skirt 5*b* extends further downwardly than the seat 5*a* and is provided with at least one air passageway or groove 5*c*.

During assembly, the parts can be placed on the tube in the stacked order shown in FIG. 1 and can be directly assembled by pressing the bush member over the container after the pump has been inserted into the container. However, this would assume that the container was filled with liquid, so that the complete assembly would take place at this stage on the premises of the user. Alternatively, the device can be assembled empty and then filled by intrusion, which is relatively inappropriate in the case of plastic containers with a small capacity.

In accordance with the present invention, the assembly operation is effected by first assembling the pump 2 separately to the bush member 4 to form a sub-unit. More particularly, the bush member is first fit onto the pump 2, so that the mechanism of the piston 3 is sealed against the flange 4*b* forming the cover and the nozzle 3*a* passes through the axial opening in the flange. The pump is held in this position by the collar 2*b* being engaged by the locking ring 4*c*. This is the same position of these parts as they have in the inoperative position of the dispensing device as shown in the right-hand side of FIG. 2. In this position, the seating of the piston to the flange by its internal 3*b* spring the passageway 2*c* against communicating with the atmosphere.

The sub-unit of the connected pump and bush member can then be placed on the container 1 which has previously been filled with the desired product dose. The assembly in this manner ensures the definitive fixing and cone-to-cone sealing of the facing surfaces of the upper end 1*a* of the container and the skirt 4*a* of the bush member 4. In the final assembled position, the locking ring 4*c* is disposed between the collar 2*a* and the rim 1*d* of the tube as shown at the left of FIG. 2.

In the left-hand part of FIG. 2, the device is shown in the operating position of the dispenser. The lowered head 5 has served as a plunger for the nozzle 3*a* in order to force down the piston. Till this position of the parts, the container is linked with the atmosphere for permitting entry of air into the container 1 as the liquid is dispensed. The travel has been limited by the contacting of the skirt 5*b* of the heads with flange 4*b*.

The right-hand part of FIG. 2 shows the external appearance of the assembled dispenser in the inoperative state. Here, the various internal members are shown in dotted line form, the ferrule 4*d* just covering the edge of the skirt 5*b* of the head. Return to the upper position is effected by the internal spring of the piston 3, which in turn tightly abuts against the cover formed by the flange 4*b* for closing off communication between the atmosphere and the venting passageway 2*c* from the container.

The lowered position of the piston as shown in the left side of FIG. 2 is also used for assembly of the pump and bush member to the container. During this operation, the connected pump 2 and bush member 4 sub-unit is seized by a vertically moving mandrel of an assembling machine. This mandrel places the sub-unit on the top of the tube 1 with the pump extending into its open end. In doing this, the mandrel will first bear on the nozzle and therefore the piston 3, rather than the actual bush member. As the skirt 4*a* of the bush member starts its telescoping movement over the wall la of the tube, a frictional resistance to further downward movement of the bush member 4 is created. This causes the piston to give way and move away from sealing engagement with the flange 4. This, in turn opens the vent passageway 2*c* of the pump to connect the inner space of the container to atmosphere. With this connection of the inner space of the container to atmosphere, the bush member 4, and in particular the skirt 4*a*, can then be slid over the upper end wall 1*a* of the tube 1 while in radial sealing engagement therewith and the air initially entrapped in the container and bush member allowed to escape to atmosphere.

During the assembly movement, the bush member is held in the assembling machine against upward movement by engagement with a suitable abutment in the machine. This makes it possible to transmit to the bush member the fitting force necessary for moving it fully onto the upper part 1*a* of the tube, while avoiding any overloading of the mechanism, until the collar 2*b* abuts against the rim 1*d* of the wall 1*a*. In this final position, the skirt 4*a* leaves a randomly variable axial clearance at the shoulder 1*b*, while the radial sealing engagement of the facing surfaces of the shirt 4*a* and upper part 1*a* of the tube makes the assembly tight and quasi-irreversible.

With the above described assembly procedure, it is not necessary to provide any grooving in either the skirt of the bush member or in the upper end of the tube. The position of the parts during the assembling operation is instead made the same as occurs during the normal dispensing operation when the atomizing head 5 is depressed by the user of the device.

Although the assembling operation takes place on a tube already filled with liquid, the fitting of the bush member seals the assembly without the free volume of the container leading to an abnormal rise in its internal pressure, since the venting mechanism of the pump is held open.

As an alternative, it is pointed out that the atomizing head 5, which is of a known type, could be put into place in the upper end of the bush member 4 at the start of assembly and, thus take the place of a specific pressing tool on the mandrel for depressing the pump. The head thus fulfills the function described hereinbefore via the abutment limiting the travel of the piston on the pump. The passageway 5c maintains communication of the interior of the tube with the atmosphere in this position of the head. The seat 5a could apply with respect to a head with a skirt projecting on the bush, that means of increased overall dimensions. However, with regards to the transmission of forces, a direct engagement of the mandrel with the pump during the assembly operation with subsequent attachment of the head, is preferred.

Finally, to avoid the expulsion of a certain liquid quantity through the nozzle, it is preferable to use a pump able to withstand a certain overpressure of the container by sealing at least one of its joints, e.g. the slide-valve-type admission joint or more conventionally an exhaust joint able to create a precompression.

The cylindrical shape of revolution of the dispensing device is as compact as possible, the length of the tube 1 determining the internal volume, obviously with adaptation of the fill tube 2a. Despite the assembly of the device being very simple, it is effective and entirely tight in the inoperative state.

We claim:

1. A miniature dispenser for products used in very small doses, comprising:

a) a container (1) having a tubular container wall with a closed bottom and an open top, said container defining a longitudinal axis extending between the open top and closed bottom thereof and having an upper wall surface (1a), extending from its open top, of predetermined surface contour;

b) a piston pump (2) insertable within the open top of the container, said pump having:

i) a pump housing (2), i) a piston (3) reciprocably mounted within said pump housing for axial movement along said longitudinal axis, iii) spring mean within said pump housing for urging said piston outwardly of the open end of the container to seal the interior of the container from communicating with the atmosphere when the piston is positioned within said container (1), iv) a nozzle (3a) fixed to said piston (3) for movement therewith, and v) venting means for connecting the interior of the container (1) to atmosphere when the piston is positioned within said container and the piston (3) is moved axially, against the force of the spring, along said longitudinal axis; and c) an outer tubular bush member (4) having a tubular bush wall with an open top and an open bottom for positioning of the open bottom thereof onto the open top of the container in telescoping relationship therewith, said bush member further having:

i) a flange (4b) extending internally across the bush wall intermediate its top bottom, said flange having an opening therethrough for receiving the nozzle (3a) of the pump (3) with the nozzle (3a) disposed in an extended position on the side of the flange facing the open top of the bush wall, and ii) means for securing said pump housing (2) to said bush member (4) against axial movement relative thereto and with the nozzle (3a) thereof in said extended position, and iii) the bush wall below the flange (4b) having a lower wall surface (4a) of predetermined surface contour complementary to that of the upper wall surface (1a) of the container (1) for radial sealing engagement therewith over its entire circumferential periphery as the two surfaces are moved into telescoping relationship, and the frictional forces created by said sealing engagement being greater than the force of the spring means urging the piston outwardly of the open end of the container.

2. A dispenser according to claim 1, characterized in that the pump is a precompression pump.

3. A dispenser according to claim 1, characterized in that the cross-section of the device differs from a circular contour, while retaining a substantially uniform wall thickness.

4. A dispenser according to claim 1 characterized in that the pump further includes a collar (2b) for resting on the open end of the container (1) when the pump housing (2) is fully inserted into the container and the means for securing the pump housing (2) to said bush member (4) is defined by a locking ring (4c) extending radially inward of the wall of the bush member.

5. A dispenser according to claim 4, characterized in that the container and the bush member (4), have a generally cylindrical shape, are made from synthetic, injection molded materials, the container having the wall (1a) at its open top of reduced thickness to form an outer shoulder, the bush member is relatively short in axial length compared to the length of the container, and the external generatrices of the relatively short bush member being aligned during assembly with those of the wall at the bottom of the container in order to produce a substantially cylindrical outer shape to the assembled device.

6. A dispenser according to claim 4, characterized in that the container and the bush member are made from different materials, the container being more resistant to the product it is to contain and the bush member being less rigid.

* * * * *